US007076966B2

(12) United States Patent
Mullen

(10) Patent No.: US 7,076,966 B2
(45) Date of Patent: Jul. 18, 2006

(54) REFRIGERATED LIQUID DISPENSING SYSTEM

(76) Inventor: James T. Mullen, 237 Pond View, Chadds Ford, PA (US) 19317

( * ) Notice: Subject to any disclaimer, the term of this patent is extended or adjusted under 35 U.S.C. 154(b) by 103 days.

(21) Appl. No.: 10/967,594

(22) Filed: Oct. 18, 2004

(65) Prior Publication Data

US 2006/0080993 A1 Apr. 20, 2006

(51) Int. Cl.
*B67D 5/62* (2006.01)

(52) U.S. Cl. ..... 62/337; 62/390; 222/132

(58) Field of Classification Search ..... 62/337–339, 62/389–400; 141/198; 222/129, 132, 185.1, 222/529

See application file for complete search history.

(56) References Cited

U.S. PATENT DOCUMENTS 2,274,409 A * 2/1942 Harbison ..... 222/183
2,408,704 A * 10/1946 Taylor ..... 222/160
2,779,165 A * 1/1957 Pichler et al. ..... 62/320
2,781,153 A * 2/1957 Roberts ..... 222/183
2,914,218 A * 11/1959 Korodi ..... 222/131
2,982,114 A * 5/1961 Cobb et al. ..... 62/338
4,469,150 A * 9/1984 Grimaldi ..... 141/95
5,064,097 A * 11/1991 Brog et al. ..... 222/129
5,228,286 A * 7/1993 Demura ..... 60/276
5,542,265 A * 8/1996 Rutland ..... 62/389
6,039,219 A * 3/2000 Bach et al. ..... 222/160

* cited by examiner

*Primary Examiner*—William E. Tapolcai
(74) *Attorney, Agent, or Firm*—Connolly Bove Lodge & Hutz

(57) ABSTRACT

A refrigerated liquid dispensing system includes a cabinet having a refrigerated compartment. At least one liquid container such as a water bottle is mounted in a receptacle in the compartment. A valve is mounted to the neck of the bottle for controlling the flow of liquid from the bottle. In one practice of the invention the valve is actuated by a spring plunger mounted to the door of the compartment so that the valve can be actuated without opening the door to dispense water from a valve stem into a cup in a cup holder area below the compartment. In a further practice of the invention the valve is actuated by opening the door and acting directly on the valve. When the door opens a valve extension automatically slides outwardly so that a dispensing opening in the valve extension is disposed against a cup in the cup holder area.

16 Claims, 5 Drawing Sheets

REFRIGERATED LIQUID DISPENSING SYSTEM

BACKGROUND OF THE INVENTION

Liquid dispensers are used wherein a container, such as a bottle, is associated with a cooling or refrigeration system so that the water or other liquid, such as milk, cream, juices, ice tea, fruit drinks, lemonade, wine and other liquids will be cool. Such use of liquid dispensers has been common in restaurants, bars, cafeterias, convenience stores, offices, homes and factories. It is a common practice where the water, for example, is then periodically dispensed into a cup or other receptacle. Such water coolers as conventionally used create serious health dangers because of the lack of proper sanitation. For example, the bacteria level could be dangerously high. The worst offenders are coolers with quick bottle-replacement rate.

A further complaint of customers of bottled water systems is the need to replace the empty bottle with a filled bottle which could weigh, for example, 43 pounds. The bottled water industry is growing rapidly, with customers wanting easier replacement capabilities, availability of flavored waters and freedom from sanitation concerns.

SUMMARY OF THE INVENTION

An object of this invention is to provide a refrigerated liquid dispenser system which can readily use disposable containers or bottles thereby eliminating the need to continually cleanse, sanitize and fill each container or bottle for future use.

Another object of this invention is to provide a refrigerated liquid dispensing system whereby each time a user replaces a container or bottle the total dispensing system is replaced. This removes the need to clean and sanitize the system as well as the need to return empty containers or bottles. Thus, the coordination of the system evolves from a two-way delivery structure generally used in the prior art to a one-way delivery system of this invention.

In accordance with this invention a refrigerated liquid dispensing system includes a cabinet which has a refrigerated compartment. A cup holder area is located below the refrigerated compartment with the compartment door being forwardly of the cup holder area so that the cup holder area is thereby recessed into the cabinet. At least one liquid container, such as a bottle, is mounted on a container receptacle in the compartment. The container is mounted in such a manner as to be maintained in a fixed upright condition. A dispensing neck is provided at the lower end of the container in flow communication with a valve so that the liquid, such as water, may selectively flow from the container when the valve is actuated to its open condition.

In accordance with one practice of this invention the valve is actuated by an inward pressing force in such a manner that the actuation could be accomplished through use of an actuating member such as a spring biased plunger mounted on the door of the compartment. As a result, a user could externally press against the actuating member and the actuating member would push against the valve to place the valve in its open condition. The valve includes a valve stem which extends through a bottom wall of the compartment and leads to the cup holding area so that the discharged liquid could be collected in a receptacle such as a cup.

In a further practice of this invention the system could be mounted in a conventional refrigerator wherein the interior is the refrigerated compartment. A valve extension is provided in flow communication with the valve. The valve extension is slidably mounted in the compartment to be moved to and from two different conditions. One condition is the stored condition when the valve extension is completely within the compartment and when the compartment door is closed. The other condition is the use condition when the door is opened and the valve extension slides outwardly so that a portion of the valve extension is disposed outside of the compartment above the cup holder area. In such case the cup holder area is simply where the user holds the cup externally of the refrigerator below the valve extension. As a result, when the valve is actuated to its opened condition the liquid may flow through the container to the valve and into the valve extension and then be discharged through a discharge opening in the valve extension and be collected in a cup or the like held by the user.

In one preferred practice of this invention the housing contains a lower refrigerated compartment with the cup holder area being between both refrigerated compartments. The lower compartment could be used to store such items as extra water bottles and/or other types of objects needing refrigeration such as canned or bottled drinks, fruit, etc. In a practice of the invention the upper compartment houses a plurality, such as one or multiple containers each with its own associated neck and valve and other related structure of the system. A divider is located in the upper refrigerated compartment to properly locate each of the containers.

The refrigerated compartment could be located in the upper portion of a cabinet having a lower refrigerated compartment which could store other containers or other items which should be refrigerated. The cup holder area would be located between both refrigerated compartments. Alternatively, the cabinet could have only a single refrigerated compartment so as to be free-standing or a counter top unit. With such free-standing or counter top unit the cup holder area could be the lowermost portion of the cabinet. Alternatively, the free-standing or counter top cabinet could extend slightly outwardly of the counter top so that the cup holder area would, in effect, be an area located below the valve where the user could simply hold the cup and collect the liquid being dispensed.

In a practice of the invention the container receptacle has a horizontal lower surface disposed on a skid pad on the bottom wall of the refrigerated compartment. The upper surface of the receptacle, however, is downwardly inclined toward the compartment door. The receptacle further includes a transverse channel which receives the heel of the container or bottle so as to properly locate and assist in stably mounting the container.

In the practice of the invention wherein the valve extension is slidably movable it is preferred that biasing structure urge the valve extension to its outward or use condition. When the door of the refrigerated compartment is closed, however, the door would keep the valve extension in its inward or stored condition. Thus, upon opening the door the valve extension automatically slides outwardly. Any suitable biasing structure, such as a spring or bellows could be used.

A distinct advantage with the various practices of this invention is to minimize the likelihood of bacteria in the system, particularly in the valve portion of the system. In that regard, the valve is permanently connected to the container and thus the valve is disposed of along with the container. Further, in the practice of the invention where the liquid is dispensed by having a refrigerated compartment with the door closed the only portion of the valve not contained within the refrigerated compartment is the small tip of the valve stem. In the embodiment of the invention where the liquid is dispensed while the door is opened all of the valve components are maintained within the refrigerated compartment during non-use. This feature of having all or substantially all of the valve components within the refrigerated compartment during periods of non-use further minimizes the possibility of bacteria contaminating the system.

THE DRAWINGS

DETAILED DESCRIPTION

Figure 1:
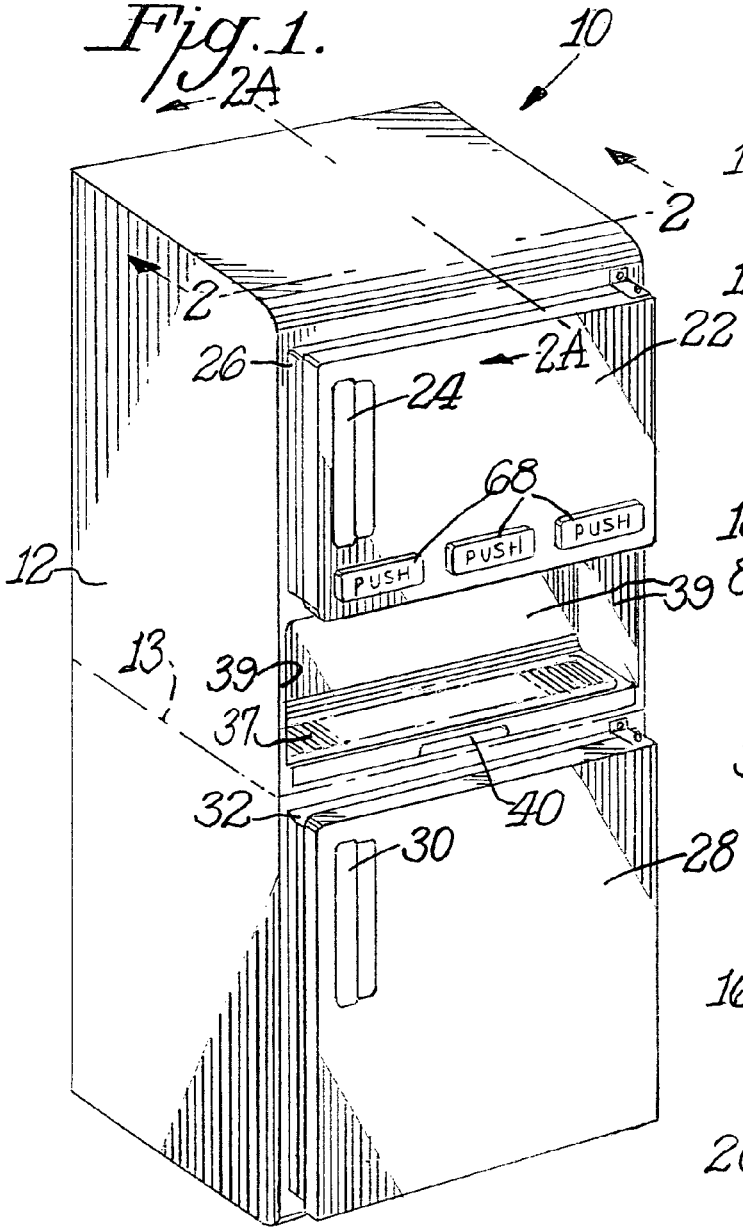
FIG. 1 is a perspective view of a refrigerated liquid dispensing system in accordance with one embodiment of this invention.

FIGS. 1–4 illustrate a refrigerated liquid dispensing system 10 in accordance with one embodiment of this invention. As shown therein, system 10 includes a cabinet 12 which is divided into a plurality of different sections. One of the sections includes an upper or top refrigerated compartment 14, a bottom or lower refrigerated compartment 16, and an intermediate cup holder area 18 which is recessed into the cabinet. A compressor section 20 is provided at the bottom of the cabinet to cool the top compartment 14 and bottom compartment 16 in a conventional manner which could include, for example, an evaporator extending between the two refrigerated compartments at the rear side of the cabinet. The back wall of the cabinet could contain a screen type plate having vent holes for the escape of heat and outward projections to assure that the cabinet would be spaced from the wall of a room.

A door 22 is located in the vertical front wall of cabinet 12 to selectively open and close access to top refrigerated compartment 14. Door 22 could include, for example, a recessed handle 24 and would be provided with a peripheral sealing gasket 26 to assure the sealing of compartment 14 in a known manner. Similarly, bottom refrigerated compartment 16 would be provided with a door 28 having a handle 30 and a gasket 32. Although recessed handles are shown for each door, the doors and the refrigerated sections or compartments may have any known conventional structure except as otherwise noted where important to the practice of this invention.

Figure 2:
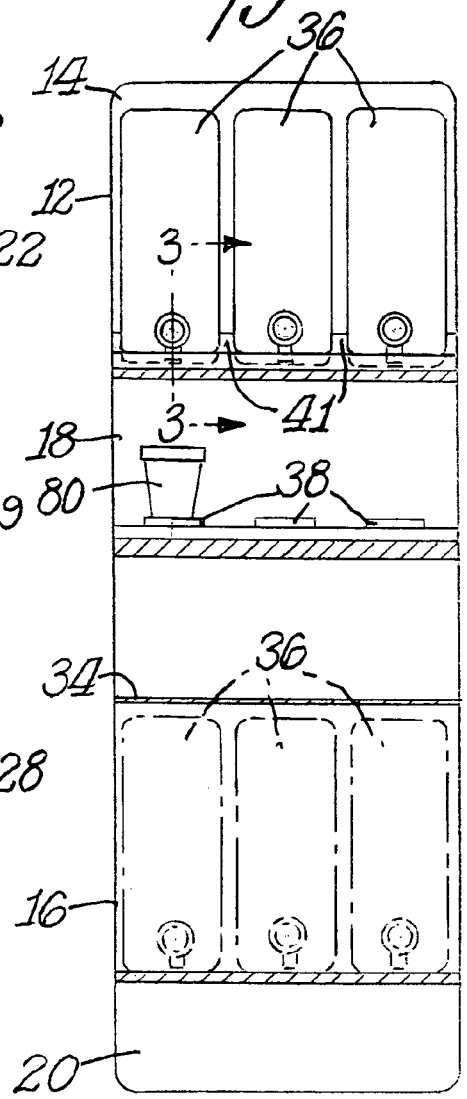
FIGS. 2 and 2A are cross-sectional views taken through FIG. 1 along the lines 2—2 and 2A—2A, respectively.

As shown in FIG. 2 bottom compartment 16 may include one or more shelves 34 which could be adjustable in height to separate the compartment into two or more sections. Any desirable use could be made of the two sections. FIG. 2 illustrates the lower section to house a plurality of containers such as bottles 36. The shelf 34 may be used for other objects such as cans, bottles or any other objects which should be cold stored.

As shown in FIGS. 1–2 the cup holder area 18 is enclosed by back and side walls 39. A removable drip tray 37 is located above the bottom wall in a recess in the bottom wall of cup holder area 18. Drip tray 37 could be of any suitable construction, such as a metal plate having slots or spaced slats so that any excess liquid in the cup holder area 18 would flow through the drip tray 37 and be collected. Drip tray 37 also includes a handle 40 to permit ready removal of the drip tray for cleaning purposes. As shown in FIG. 2 the cup holder area 18 may also include an appropriate number of cup stops 38, each of which would be located in association with a respective one of the containers or bottles 36 in top compartment 14.

Cabinet 12 may be made of any suitable materials and dimensions as is known and used in the art. For example, the overall height of cabinet 12 could be 48 inches and the width 16 inches with a depth of 13 inches. Top compartment 14 could have a height of about 13.5 inches. Bottom compartment 16 could have a height of about 19.75 inches. The cup holder area 18 could have a height of about 9 inches. It is to be understood that these dimensions are not critical to the practice of the invention and are only given as exemplary dimensions.

The invention may be practiced where the cabinet 12 is free-standing so as to be capable of being placed on a counter top. In such practice of the invention in order to minimize the size of the cabinet 12 the cabinet 12 would not include the lower compartment. Thus, the effective height of cabinet 12 would be from the top of the cabinet to the phantom line 13 illustrated in FIG. 1 which is at the bottom of the cup holder area 18. With this modified cabinet the cup holder area 18 would thus be the lowermost portion of the cabinet. If desired, cabinet 12 could end at the bottom of top compartment 14 and by extending the cabinet so that it overhangs the counter top the liquid could be dispensed into a cup or other container held by the user near the counter top. In that regard, the cup holder area would be the area where the user physically holds the cup or other receptacle.

The previous description of cabinet 12 would generally apply to each of the practices of this invention. The individual practices differ with regard to how the actual dispensing is effectuated. In addition, the practices of FIGS. 5–13 are particularly adaptable for use with conventional refrigerators such as for home and office use.

A common feature to all of the practices of this invention is that the top compartment 14 would include at least one and preferably more, such as two or multi, individual containers 36. Such containers could be of any suitable form such as a bag or box. Preferably each container is a two gallon or a two and a half gallon bottle. Such size bottle would have distinct advantages over prior practices using, for example, a five gallon bottle. In that regard, a five gallon bottle of water would conventionally weigh about 43 pounds while a two gallon bottle of water would weigh only 16 pounds. This results in greater ease in the handling of the containers, particularly when it is necessary to remove an empty container and replace it with a full container. Although smaller size bottles are used than in conventional practices, in the preferred practice of this invention the cabinet 12 lends itself to the capability of dispensing the liquid or water from multiple bottles and also lends itself to conveniently storing full bottles, such as in the bottom compartment when replacement is necessary. Thus, as a comparison where the invention is practiced with four two gallon bottles, totaling eight gallons there would be more refrigerated water available than the prior art practice of using only one five gallon bottle. It is to be understood, however, that the various embodiments of this invention could be practiced with any size container or bottle. In addition, the cabinet 12 itself could be used for the storage of unused bottles or other items which generally should be refrigerated.

The bottom wall of top refrigerated compartment 14 is provided with an appropriate number of upstanding dividers 41, as shown in FIG. 2, which could extend the full length or at least a partial length of the compartment 14 from front to back so as to subdivide the compartment 14 into a number of sections corresponding to the number of bottles within the compartment. Thus, FIG. 2 illustrates two such dividers 41 used between adjacent sets of three bottles 36.

Figure 2A:
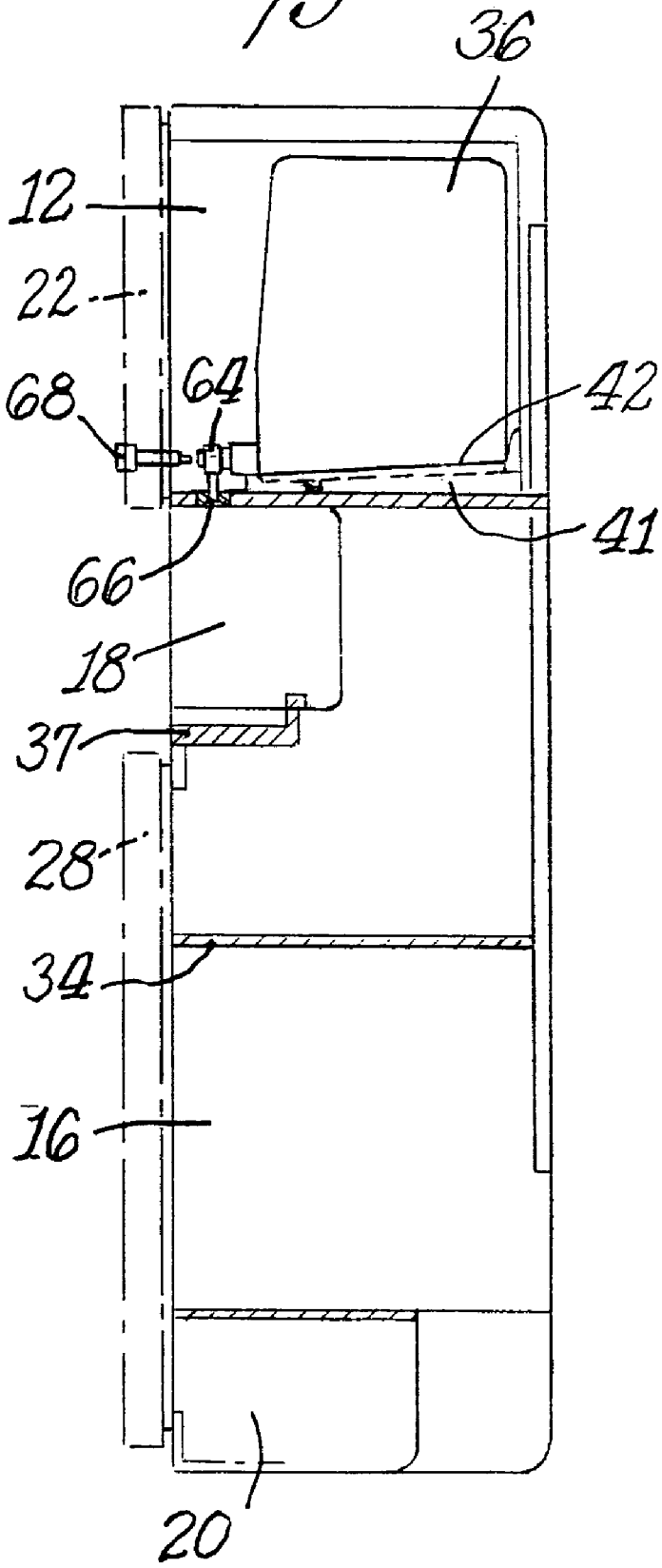
Figure 12:
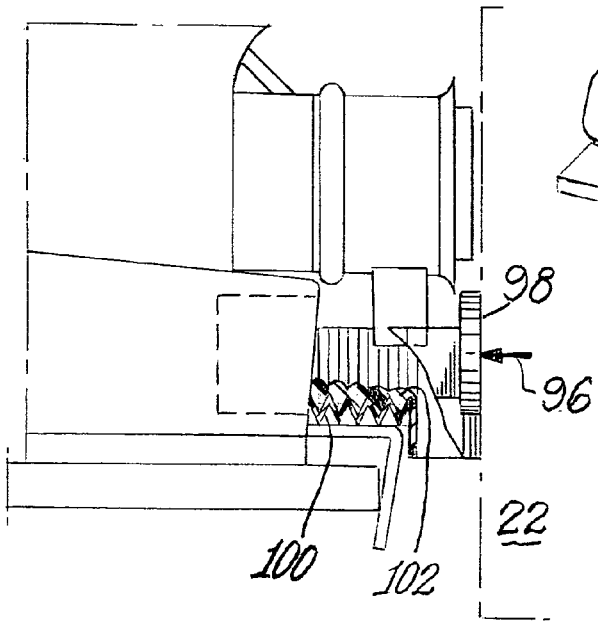
FIG. 12 is a view similar to FIG. 10, partly in section, showing the system in its stored condition.
Figure 13:
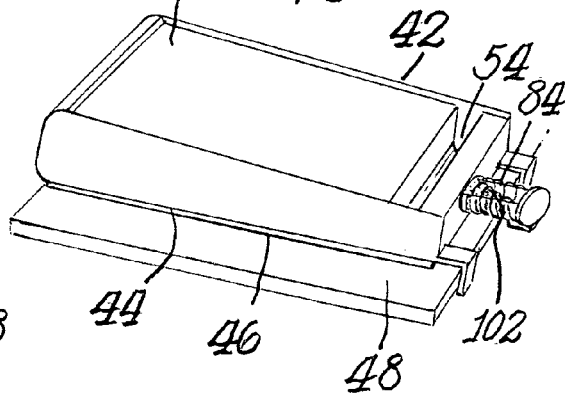
FIG. 13 is a perspective view showing the receptacle and valve extension used in the system of FIGS. 10–12.

Each bottle 36 is also provided with its own receptacle 42 which is illustrated in FIG. 2A. The receptacle 42 shown in FIG. 2A, used in the embodiment of FIGS. 1–4 has many similarities to the receptacle 42 used in the embodiments of FIGS. 5–12 and which is illustrated in FIG. 13. The receptacle of the embodiment of FIGS. 1–4 could be integral with the bottom wall 48 of compartment 14 or, as shown in FIG. 13, could be a separate member. Receptacle 42 could be made of any suitable material.

As shown in FIG. 13, the bottom wall 44 of receptacle 42 is horizontal and is mounted to a skid resistant rubber pad 46 disposed on the bottom wall 48 of top compartment 14. The skid pad 46 is particularly desirable when used on a shelf of a conventional refrigerator. The top wall 50 of receptacle 42 is downwardly inclined from back to front of compartment 14 at an angle which would correspond to the bottom wall 52 of bottle or container 36. Since the same bottle 36 may be used in all embodiments of this invention, reference may be made to various figures, such as FIG. 5, for the details of bottle 36. Top wall 50 of receptacle 42 may also be recessed (as illustrated) to be of a size and shape corresponding to and thus permitting the snug fitting of bottle 36. Channel 54 on top wall 50 extends completely across receptacle 42 as shown in FIG. 13. Channel 54 is of a size and shape to snugly receive the heel or downwardly extending solid rib 56 of bottle 36. This assures that bottle 36 will be firmly mounted in its upright condition. Thus, the structure such as the heal 56 of bottle 36 may be considered as mounting structure which is engaged with complementary mounting structure in receptacle 42 such as channel 54. Where top wall 50 is recessed, the recessed top wall may also be considered as part of the complementary mounting structure.

The downwardly angled or inclined top wall 50 in combination with the inclined bottom wall 52 of bottle 36 assures that flow of the liquid will be toward the lower dispensing corner of bottle 36 where a dispensing neck 58 is located. Container 36 may include other convenient structure such as a handle 60 at its upper end. Handle 60 could be an opening which extends completely through the bottle 36 or could be indentations in the side walls of the bottle. Reinforcing ribs 62 might also be provided for bottle 36, as illustrated. Where bottle 36 is disposable, bottle 36 could have an air vent at its top which would snap off to facilitate the dispensing of the water.

Neck 58 of container or bottle 36 is mounted to a valve 64 which may be of any suitable construction. Valve 64 could be, for example, of the type marketed by LF of America, LLC. In the preferred practice of this invention particularly in the embodiment illustrated in FIGS. 3–4, valve 64 is moved from its closed to its open position by an inward pushing, such as shown in FIG. 4. The details of valve 64 are not otherwise critical to the practice of this invention, other than it is required that the valve be movable to and from a closed condition and an open condition which would selectively either stop or permit flow of the liquid through neck 58. In the illustrated form valve 64 includes a valve stem 66 which is hollow and has an open bottom through which the liquid may be discharged.

In the embodiment of the invention illustrated in FIGS. 1–4 valve 64 is operated by an actuating member which is in the form of a push plate 68 mounted externally of door 22. Push plate 68 is rigidly secured to a plunger 70 and is urged or biased to its outward condition shown in FIG. 3 by spring 72. Valve stem 66 is inserted through an opening 74 in the bottom wall of top compartment 14. Opening 74 is suitably sealed by a rubber grommet or other sealing member 76 as shown in FIG. 4.

Figure 3:
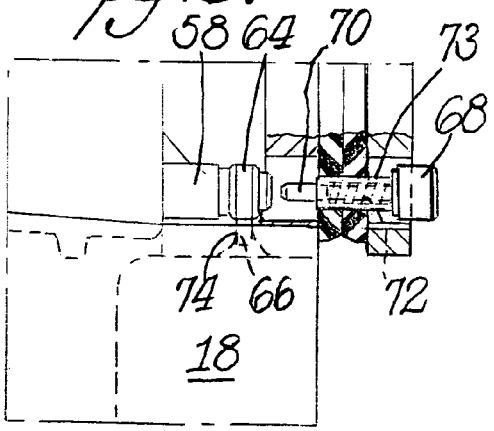
FIG. 3 is a cross-sectional view taken through FIG. 2 along the line 3—3.
Figure 4:
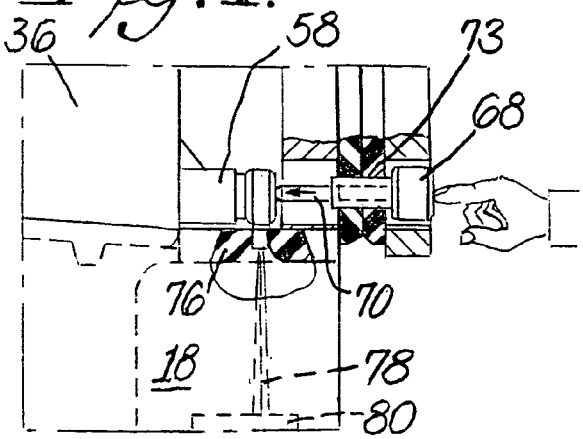
FIG. 4 is a view similar to FIG. 3 showing the system in its operating mode.

Spring 72 and a portion of plunger 70 are mounted in housing 73 which is located in a sealed opening in door 22, as shown in FIGS. 3–4.

When it is desired to obtain a liquid such as water from the bottle 36 the user presses against plate 68 as shown in FIG. 4. The force of the spring is overcome to push plunger 70 against valve 64 thereby moving the valve from the closed condition shown in FIG. 3 to the open condition shown in FIG. 4. The liquid 78 then flows through neck 58 and valve 64 from stem 66 where it is collected in cup 80 or any other suitable receptacle. After a sufficient amount of liquid has been collected in cup 80 the user releases or ceases pressing against plate 68 of the actuating member so that the plunger 70 is retracted back to the condition shown in FIG. 3 which thereby permits the valve 64 to return to its closed position and the liquid no longer flows from bottle 36.

As previously noted the invention may be practiced for dispensing various types of liquids such as water, milk, cream, juices, iced tea, fruit drinks, lemonade, wine and other liquids. Where other multiple containers are located in top compartment 14 all of the containers may have the same liquid or each container may have a different liquid. In such case, the push plates 68 could be marked to indicate what type of liquid is in the container associated with that push plate. As an example, where FIG. 1 shows three push plates, one push plate could be marked "water", another push plate could be marked "juice" and a third push plate could be marked "lemonade". This would particularly lend system 10 for use in commercial establishments such as restaurants, bars, cafeterias and convenience stores where the liquids are being sold as well as for use in less commercial places, such as offices, homes and factories.

A particular advantage of the embodiment shown in FIGS. 1–4 is that by having the valve 64 and its components secured to the disposable bottle or container 36 the valve 64 and its components are also disposed of when a new container and its valve replace the old container. This provides a distinct sanitary advantage over conventional practices where only a bottle is replaced and the same valve system is used for all bottles or containers. As a result, the invention minimizes the likelihood of bacterial formation. A further advantage of the embodiment of FIGS. 1–4 is that during periods of non-use the only portion of the valve which is not maintained under refrigeration is the small tip of valve stem 66. Thus, substantially the entire valve and its components are maintained under cooled or refrigerated conditions which minimizes bacteria.

The feature of providing a dispensing valve which is under refrigeration at all times affords product integrity. Dairy and other food service liquid products are difficult to dispense due to the risk of bacterial growth especially in the dispensing valve. The invention addresses this problem by placing the dispensing valve under refrigeration at all times. The very tip of valve stem 66 is the only exposed area. Thus, with the invention bacteria growth is retarded.

As noted, the invention provides a marked improvement over conventional dispensing systems, particularly those using specialized bottled water trucks to transport the five gallon bottles. In such conventional systems there is a need to operate a two-way delivery system involving first distributing the full bottles and second returning the empty bottles. The invention does not require such special trucks. In that regard, with the practice of the invention, particularly when two gallon or two one-half gallon disposable bottles are used a pair of such bottles could be contained in one box. The system would be a one-way system which would permit all delivery businesses to operate in the distribution of bottled water in such a convenient manner. Office supply companies would thereby be able to delivery bottled water to their customers. The invention's operation is thereby user friendly. In the preferred practice there is no lifting of heavy (five gallon) bottles typically weighing 43 pounds. There is no cleaning or sanitizing needed for the dispenser. The need to store empty bottles is eliminated. Additional refrigeration space for storing individual bottled water or other liquids is also provided.

A further advantage of the invention is that by having the containers and the valve mechanism disposable there is no need to clean and sanitize the dispensing system. This also eliminates the need to store and return bottles which is a particular disadvantage with conventional large size bottles having, for example, five gallon capacity. The invention also does away with the need for special delivery trucks and two-way delivery systems. In that regard, with conventional practices, particularly having large size bottles special delivery trucks are used to deliver the full bottles and then return the used bottles. An offshoot of this practice is the need for the user to store the used or empty bottles until they are returned. With the invention, however, there is, in effect, only a one-way distribution system which comprises supplying the bottles. Moreover, by having a smaller sized bottle or container the delivery trucks need not be as specialized. Further, by having the containers disposable the user need not store and return the empty containers.

FIGS. 5–9 illustrate a variation of the invention wherein the valve 64 is actuated by direct pressure from the user when the door 22 of compartment 14 is open. Accordingly, this practice of the invention is readily usable with conventional refrigerators.

Figure 5:
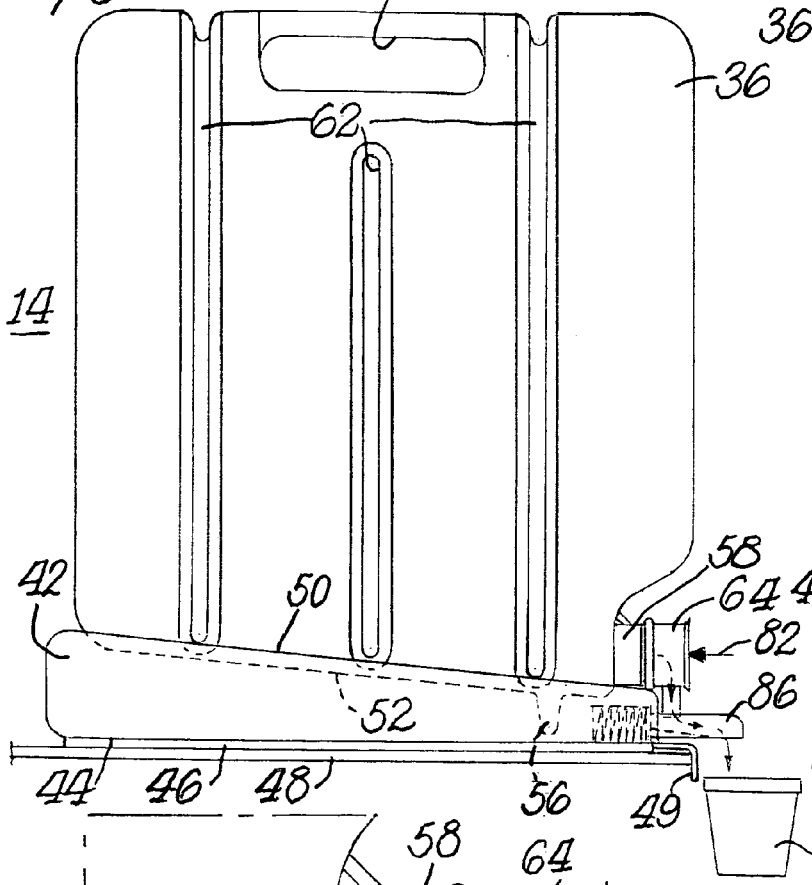
FIG. 5 is a side elevational view of a portion of a modified system in accordance with this invention.
Figure 6:
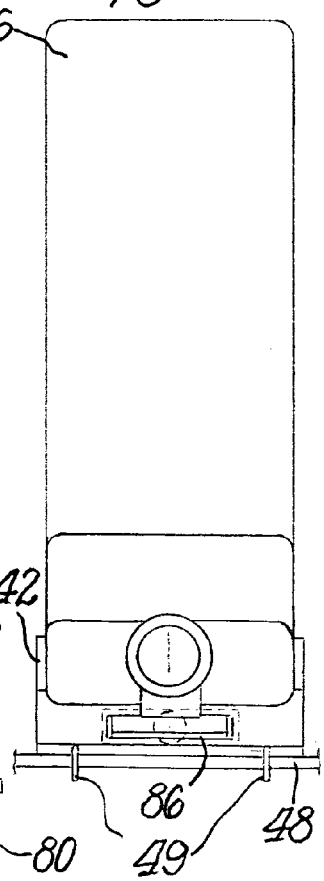
FIG. 6 is a front elevational view of the system shown in FIG. 5.

In the embodiment of FIG. 5, although a valve such as valve 64 which opens in response to an inward pushing 82 is the preferred practice of the invention, the invention could be broadly practiced with any other valve structure. What is important is that some form of valve be provided which selectively opens and closes flow of the liquid from neck 58 and permits the liquid to ultimately be received in cup 80.

Figure 8:
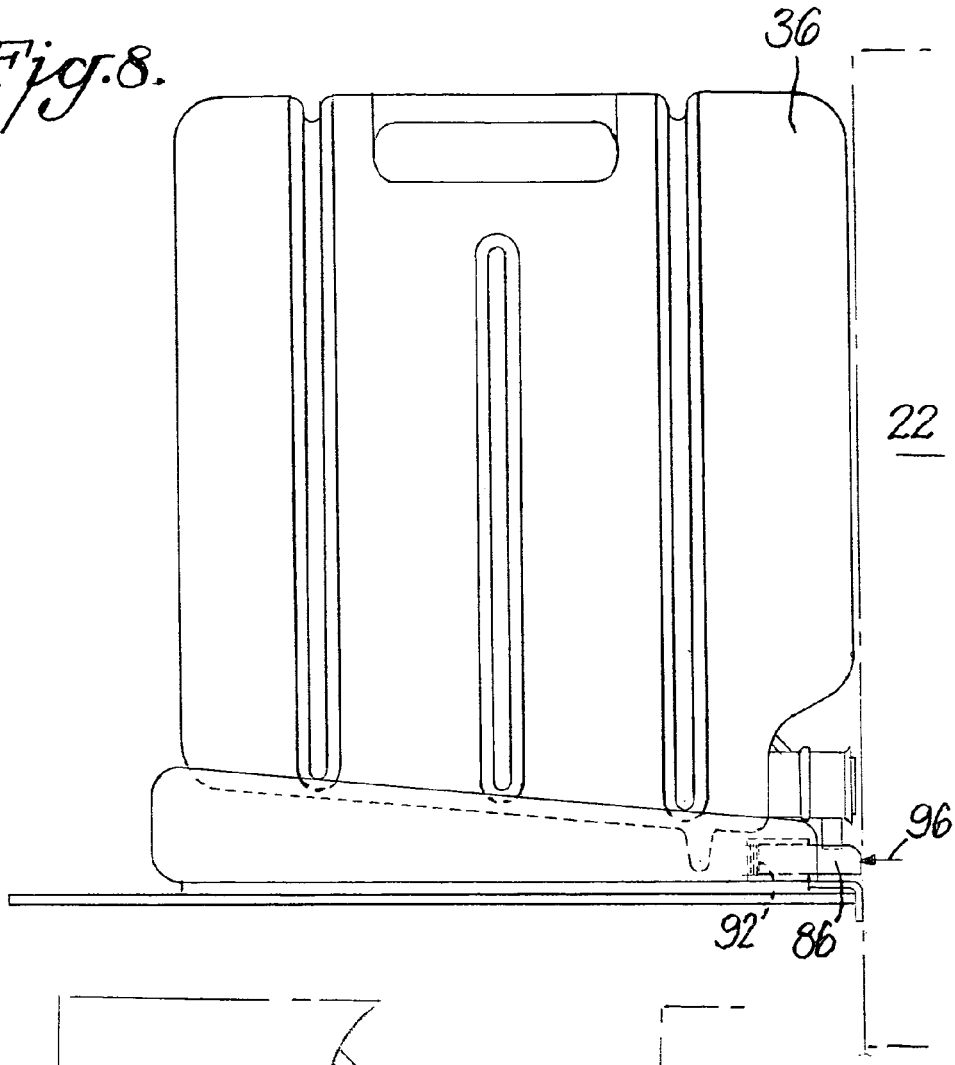
FIG. 8 is a view similar to FIG. 5 showing the system in its stored condition.
Figure 9:
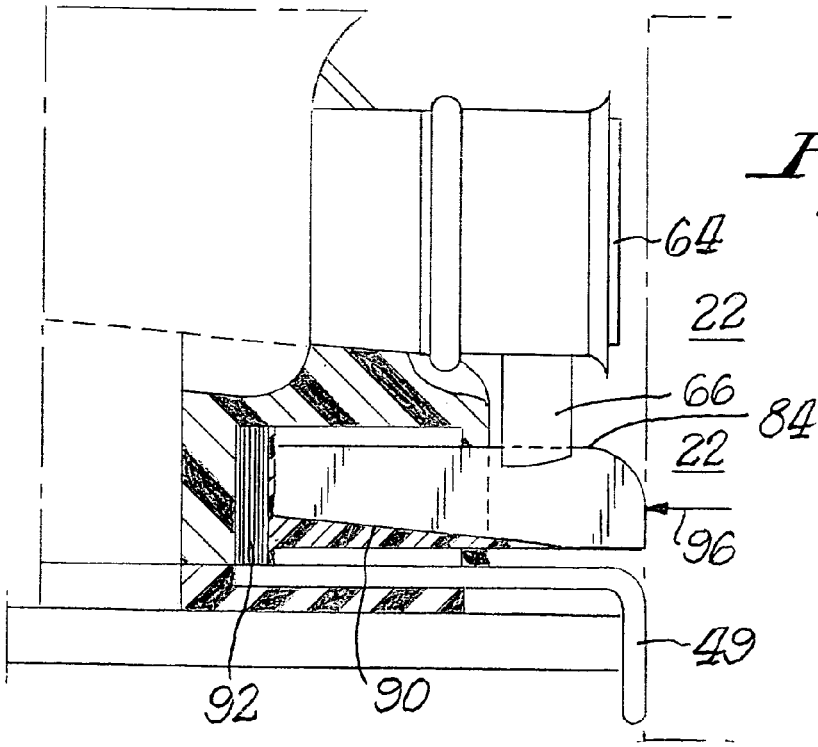
FIG. 9 is a view similar to FIG. 8 on an enlarged scale and partly in section.

In the preferred practice of this embodiment of the invention valve stem 66 is mounted in a slot 84 (see FIG. 13) in the top of a trough shaped valve extension 86. Valve extension 86 is slidably movable in a horizontal direction from a stored condition such as shown in FIGS. 8 and 9 where the end of valve extension 86 is disposed against the inner wall of door 22, to a use condition shown in FIGS. 5 and 7 when the door 22 is opened and the valve extension 86 extends partially outwardly from the refrigerated compartment 14. The length of slot 84 would be at least as long as the path of movement of valve extension 86 to and from these two positions plus the inward movement of valve 64. When valve extension 86 is in its use position shown in FIGS. 5 and 7 a discharge opening 88 in the bottom wall of valve extension 86 would be located directly above the cup 80 in the cup holding area 18. In such case the cup holder area is simply where the user holds the cup externally of the refrigerator below the valve extension. When the door 22 has been opened the valve extension 86 moves forwardly while the valve stem 66 remains stationary in the slot 84. When the valve 64 is pressed the valve 64 and the valve extension 66 move inwardly thereby causing the valve extension 66 to move more rearwardly into the slot 84.

The path of movement of the valve extension 86 could be, for example, about ½ to ¾ inches. The valve extension 86 could be about 2 inches wide.

As illustrated receptacle 42 also includes downwardly extending inverted L-shaped flanges or over hang stops 49 which are located around a bottom wall 48 or shelf in compartment 14. The over hang stops 49 are also useful in conjunction with the skid pads where the support wall of the refrigerated compartment is a wire shelf in a refrigerator.

The invention utilizing the slidable valve extension 86 may be broadly practiced where the valve extension is manually moved to its use and stored conditions by the user. Preferably, however, structure is incorporated to have valve extension 86 automatically assume these two positions. FIGS. 5–9 illustrate one practice of such automatic movement. In that practice a biasing structure is used in the form of a spring 92 mounted in a suitable chamber 94 in the bottom of receptacle 42. Spring 92 urges valve extension 86 outwardly to the use position shown in FIGS. 5 and 7. The force of spring 92, however, is overcome by the door 22 when door 22 is in the closed position shown in FIGS. 8 and 9 so that an opposite force 96 pushes valve extension 86 inwardly to the stored condition shown in FIGS. 8–9. In this stored condition valve stem 66 is located in a forward portion of the slot 84. In the extended or use condition shown in FIGS. 5 and 7 valve stem 66 is located in a rearward portion of the slot 84.

Figure 7:
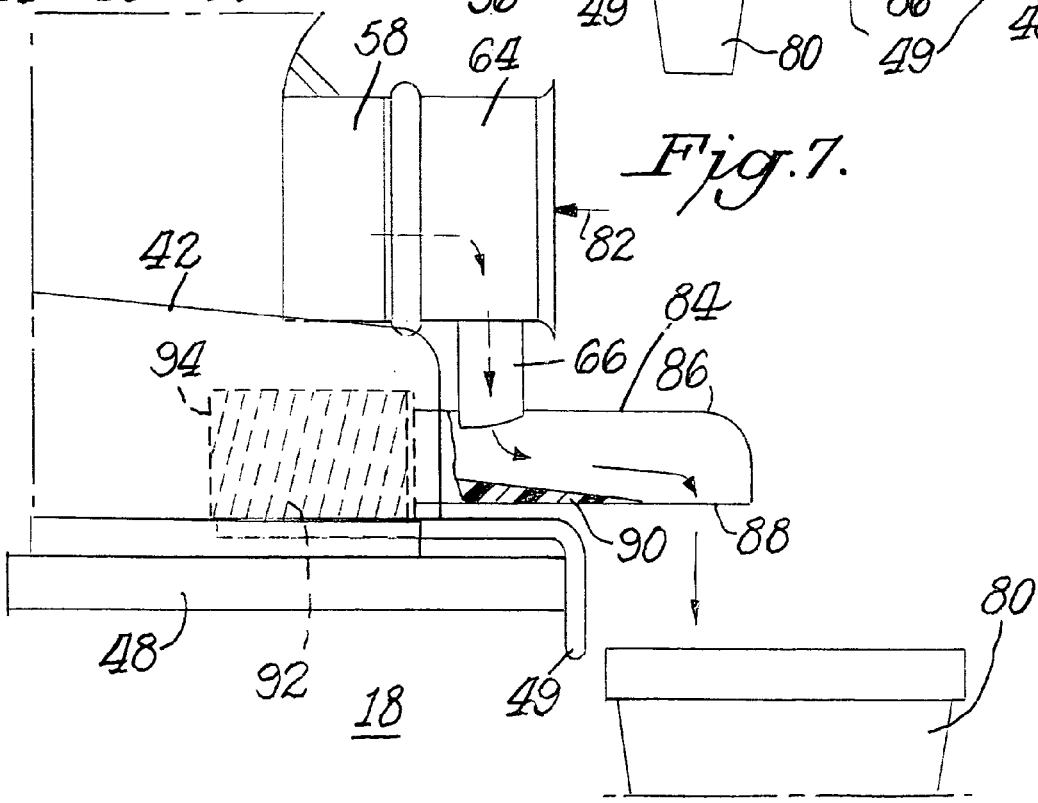
FIG. 7 is a side view partly in section showing the system of FIGS. 5–6 in its operative condition.

As illustrated in FIGS. 7 and 9 valve extension 86 has a downwardly inclined bottom wall 90 which merges into discharge opening 88 to assure that the liquid from bottle 36 will be completely discharged into cup 80 as shown by the arrows in FIGS. 5 and 7.

Figure 10:
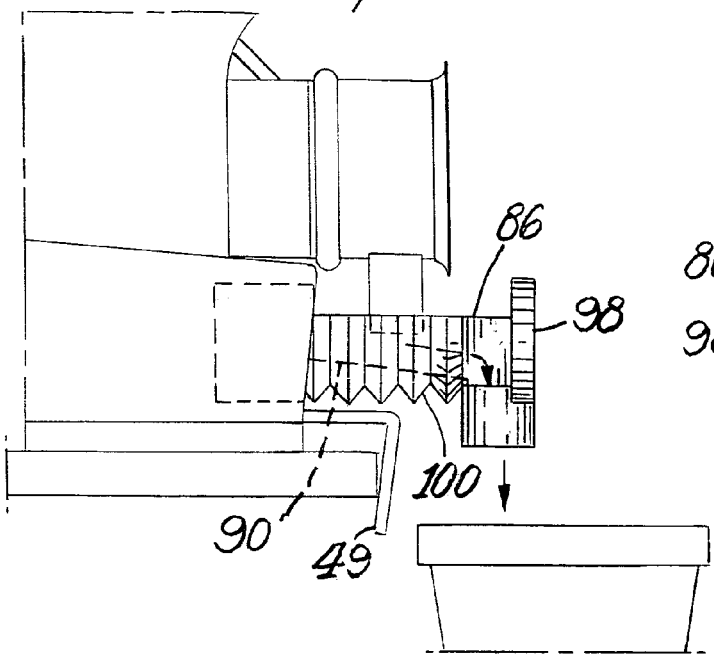
FIG. 10 is a front elevational view of a modified system similar to that shown in FIGS. 5–9.
Figure 11:
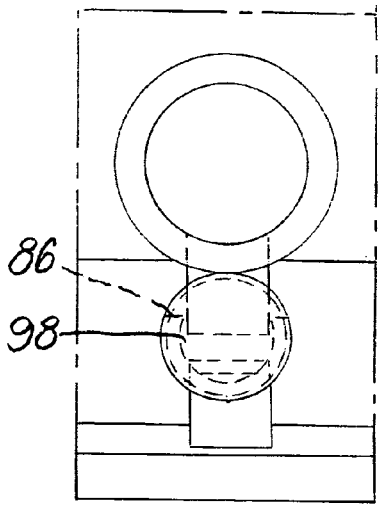
FIG. 11 is a front elevation view of the system shown in FIG. 10.

Valve extension 86 may be of any suitable size and shape. FIG. 7 illustrates the forward end of valve extension 86 to be a generally smooth curved surface. FIGS. 10–12, however, show a plate 98 located at the forward end of valve extension 86.

The over hang stops 49 assure that receptacle 42 and thus also container 36 will be properly located with respect to the forward edge of a shelf in compartment 14 for proper location of the valve extension 86 with the cup 80. In the embodiment shown in FIGS. 3–4 such stop structure is not necessary because the positioning of the valve stem 66 in the opening 74 provides proper location of the bottle 36 with respect to the cup.

FIGS. 10–13 also illustrate a variation in the biasing structure for automatically urging valve extension 86 to its use or dispensing position. Instead of using a spring the valve extension walls 100 are of a bellows construction which in its normal condition would urge the bellows outwardly as shown in FIG. 10. When, however, a force 96 is applied by door 22 pressing against plate 98, the bellows 100 is contracted to the position shown in FIG. 12. As shown in FIGS. 10 and 12 the inclined wall 90 which assures complete discharge of the liquid (FIG. 10) is the upper surface of a compressible material 102 whereby an inclined wall may be included within valve extension 86 despite the inward and outward movement of the bellows.

With the embodiments illustrated in FIGS. 9–13 the valve 64 and its related components are permanently secured to the neck 58 of the container 36. Thus, when the container 36 is disposed of the valve and its components are also disposed of. This has the previously noted benefits of retarding bacteria growth. Moreover, since the entire dispensing system is within the refrigerated compartment during periods of non-use the possibility of bacteria growth is reduced even further.

It is to be understood that while various features have been described with regard to specific embodiments, where appropriate, such features may be included in other embodiments.

What is claimed is:

1. A refrigerated liquid dispensing system comprising a cabinet, said cabinet having a refrigerated compartment, a door selectively opening and closing access to said compartment, said door being located at a vertical wall of said cabinet, a cup holder area located in said vertical wall below said refrigerated compartment, said door being located forwardly of said cup holder area whereby said cup holder area is recessed into said cabinet in relation to said door, at least one liquid container mounted on a container receptacle in said compartment, said container having mounting structure removably engaged with complementary mounting structure in said receptacle to hold said container in a fixed upright condition, said container having a dispensing neck at its lower end, a valve mounted to said neck and selectively opening and closing flow of liquid from said neck through said valve, said valve being actuated by an inward pressing force, an actuating member mounted to said door and accessible externally of said door and having a path of movement to contact said valve whereby inward pressing against said actuating member externally of said door causes said valve to open, said valve having a valve stem extending through a bottom wall of said compartment and exposed to said cup holding area, and said valve stem having a downwardly oriented discharge opening whereby liquid may flow from said container and be collected in a cup or the like in said cup holder area.

2. The system of claim 1 wherein said mounting structure and said complementary mounting structure comprises a heel extending downwardly from the bottom wall of said container and mounted in a channel located in the top wall of said receptacle.

3. The system of claim 2 wherein said top wall of said receptacle is downwardly inclined toward said door, and said bottom wall of said container being downwardly inclined at the same angle as said inclined top wall of said receptacle and in surface to surface contact with said receptacle top wall.

4. The system of claim 3 wherein said receptacle is integral with the bottom wall of said compartment.

5. The system of claim 3 wherein said top wall of said receptacle is recessed and is of a size and shape to snugly receive said bottom wall of said container.

6. The system of claim 3 wherein said container is a bottle of water having a grasping handle, and said bottle having a capacity in the range of 2–2½ gallons.

7. The system of claim 1 wherein said valve stem extends through a sealed opening in the bottom wall of said compartment.

8. The system of claim 7 wherein said actuating member comprises a push plate mounted externally of said door, and a spring biased plunger connected to said push plate biased in a direction away from said valve.

9. The system of claim 7 wherein said valve stem has a dispensing tip externally of said bottom wall of said compartment, and the remainder of said valve stem and said valve being maintained in said refrigerated compartment during periods of non-use to retard bacteria growth.

10. The system of claim 1 wherein there are a plurality of said containers and said receptacles and said valves mounted side by side.

11. The system of claim 10 including an upstanding divider extending longitudinally on the bottom wall of said compartment between sets of said containers.

12. The system of claim 10 wherein at least two of said containers contain different liquids.

13. The system of claim 1 wherein said cabinet includes a bottom refrigerated compartment located below said cup holder area.

14. The system of claim 1 wherein said actuating member comprises a push plate mounted externally of said door, and a spring biased plunger connected to said push plate biased in a direction away from said valve.

15. The system of claim 1 wherein said cabinet is a free-standing cabinet having no other refrigerated compartment.

16. The system of claim 1 wherein said valve is non-detachably mounted to said container whereby said container and said valve are jointly disposable.

* * * * *